US011139132B2

(12) United States Patent
Kroeker et al.

(10) Patent No.: US 11,139,132 B2
(45) Date of Patent: Oct. 5, 2021

(54) COMPONENT GROUP FOR GALVANICALLY SEPARATING AN ARMATURE AND A SWITCHING BRIDGE OF A RELAY, THE SWITCHING BRIDGE BEING ARRANGED ON A SWITCHING BRIDGE CARRIER, AND RELAY

(71) Applicant: TE Connectivity Germany GmbH, Bensheim (DE)

(72) Inventors: Matthias Kroeker, Ragow (DE); Peter Sandeck, Berlin (DE); Harry Koch, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 185 days.

(21) Appl. No.: 16/354,951

(22) Filed: Mar. 15, 2019

(65) Prior Publication Data

US 2019/0287747 A1 Sep. 19, 2019

(30) Foreign Application Priority Data

Mar. 16, 2018 (DE) ..... 102018204014.1

(51) Int. Cl.

| | |
|---|---|
| ***H01H 50/02*** | (2006.01) |
| ***H01H 50/18*** | (2006.01) |
| ***H01H 50/54*** | (2006.01) |
| ***H01H 50/64*** | (2006.01) |
| ***H01H 1/20*** | (2006.01) |

(52) U.S. Cl.

CPC ..... *H01H 50/026* (2013.01); *H01H 1/2008* (2013.01); *H01H 50/18* (2013.01); *H01H 50/546* (2013.01); *H01H 50/648* (2013.01)

(58) Field of Classification Search

CPC ..... H01H 50/026; H01H 50/546

See application file for complete search history.

(56) References Cited

U.S. PATENT DOCUMENTS

| | | | |
|---|---|---|---|
| 6,417,749 | B1 | 7/2002 | Kappel et al. |
| 9,799,474 | B2 | 10/2017 | Sakai et al. |
| 2015/0077202 | A1 | 3/2015 | Enomoto et al. |
| 2016/0300676 | A1 | 10/2016 | Sakai et al. |

FOREIGN PATENT DOCUMENTS

| | | | |
|---|---|---|---|
| BE | 419467 | A | 2/1937 |
| DE | 102016206130 | A1 | 10/2016 |

OTHER PUBLICATIONS

German Search Report, dated Oct. 31, 2018, 8 page.

Extended European Search Report, European Patent Application No. 19163456.7, dated Jul. 26, 2019, 7 pages.

European Patent Office Communication, dated Apr. 16, 2020, 5 pages.

*Primary Examiner* — Ramon M Barrera

(74) *Attorney, Agent, or Firm* — Barley Snyder

(57) ABSTRACT

A component group of a relay comprises a separation component formed from an electrically insulating material and having a receptacle receiving an armature of the relay and a plurality of receiving connection elements adapted to plugged together with a switching bridge carrier of the relay. A switching bridge of the relay is arranged on the switching bridge carrier. The separation component galvanically separates the armature and the switching bridge.

13 Claims, 11 Drawing Sheets

COMPONENT GROUP FOR GALVANICALLY SEPARATING AN ARMATURE AND A SWITCHING BRIDGE OF A RELAY, THE SWITCHING BRIDGE BEING ARRANGED ON A SWITCHING BRIDGE CARRIER, AND RELAY

CROSS-REFERENCE TO RELATED APPLICATION

This application claims the benefit of the filing date under 35 U.S.C. § 119(a)-(d) of German Patent Application No. 102018204014.1, filed on Mar. 16, 2018.

FIELD OF THE INVENTION

The present invention relates to a relay and, more particularly, to a component group of a relay for galvanically separating an armature and a switching bridge of the relay.

BACKGROUND

Relays often have a switching bridge for connecting two conductive contacts of a load circuit and an armature which is driven by an electromagnet of a control circuit. The armature is connected to the switching bridge by metal elements. If high-frequency interferences arise in one of the circuits, for example in the load circuit, they can be transmitted to the control circuit by the metal elements, negatively impacting the functionality of the control circuit.

SUMMARY

A component group of a relay comprises a separation component formed from an electrically insulating material and having a receptacle receiving an armature of the relay and a plurality of receiving connection elements adapted to plugged together with a switching bridge carrier of the relay. A switching bridge of the relay is arranged on the switching bridge carrier. The separation component galvanically separates the armature and the switching bridge.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
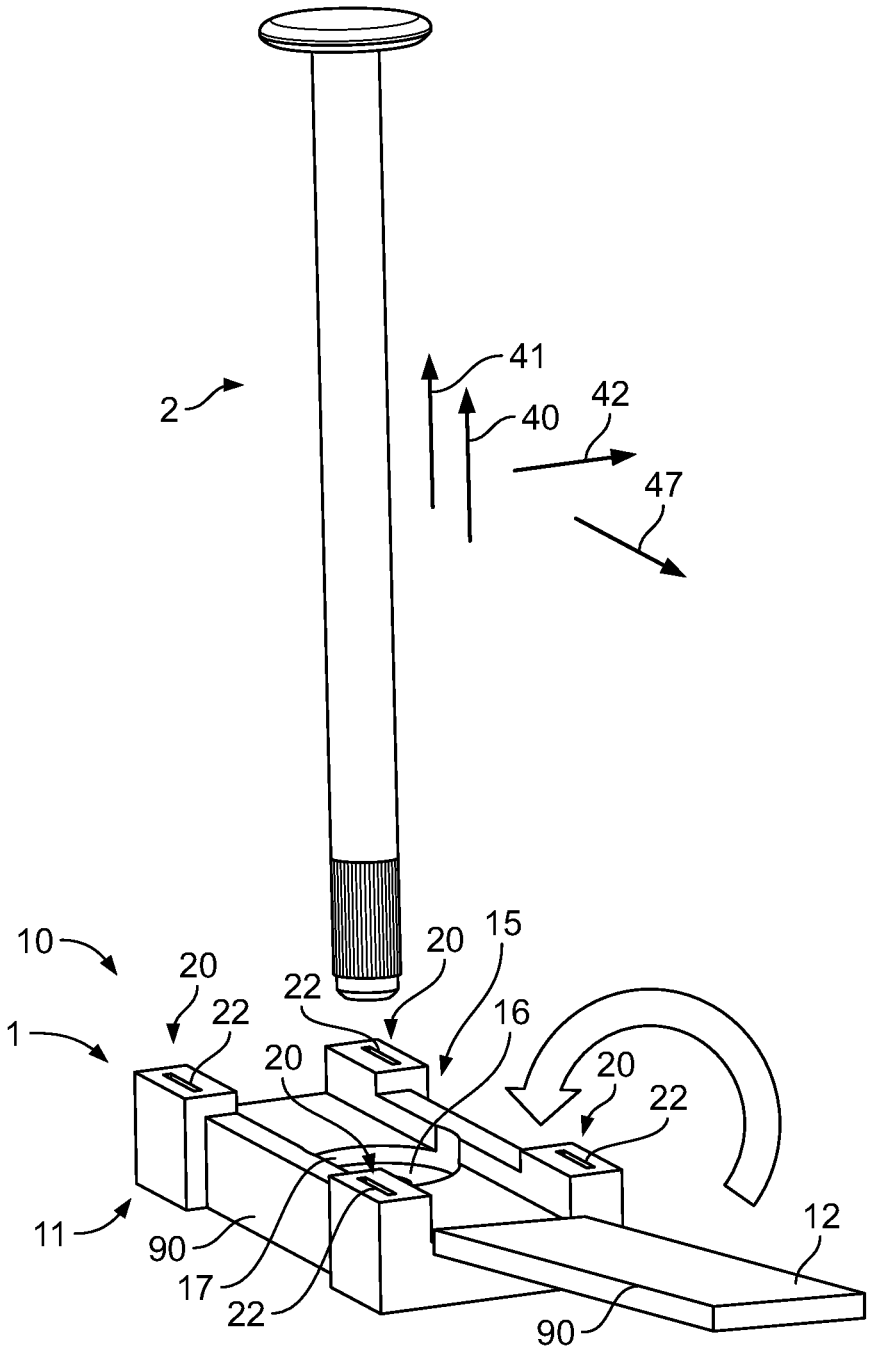
FIG. 1 is a perspective view of a component group according to an embodiment with an armature prior to insertion of the armature.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will convey the concept of the invention to those skilled in the art.

Figure 3:
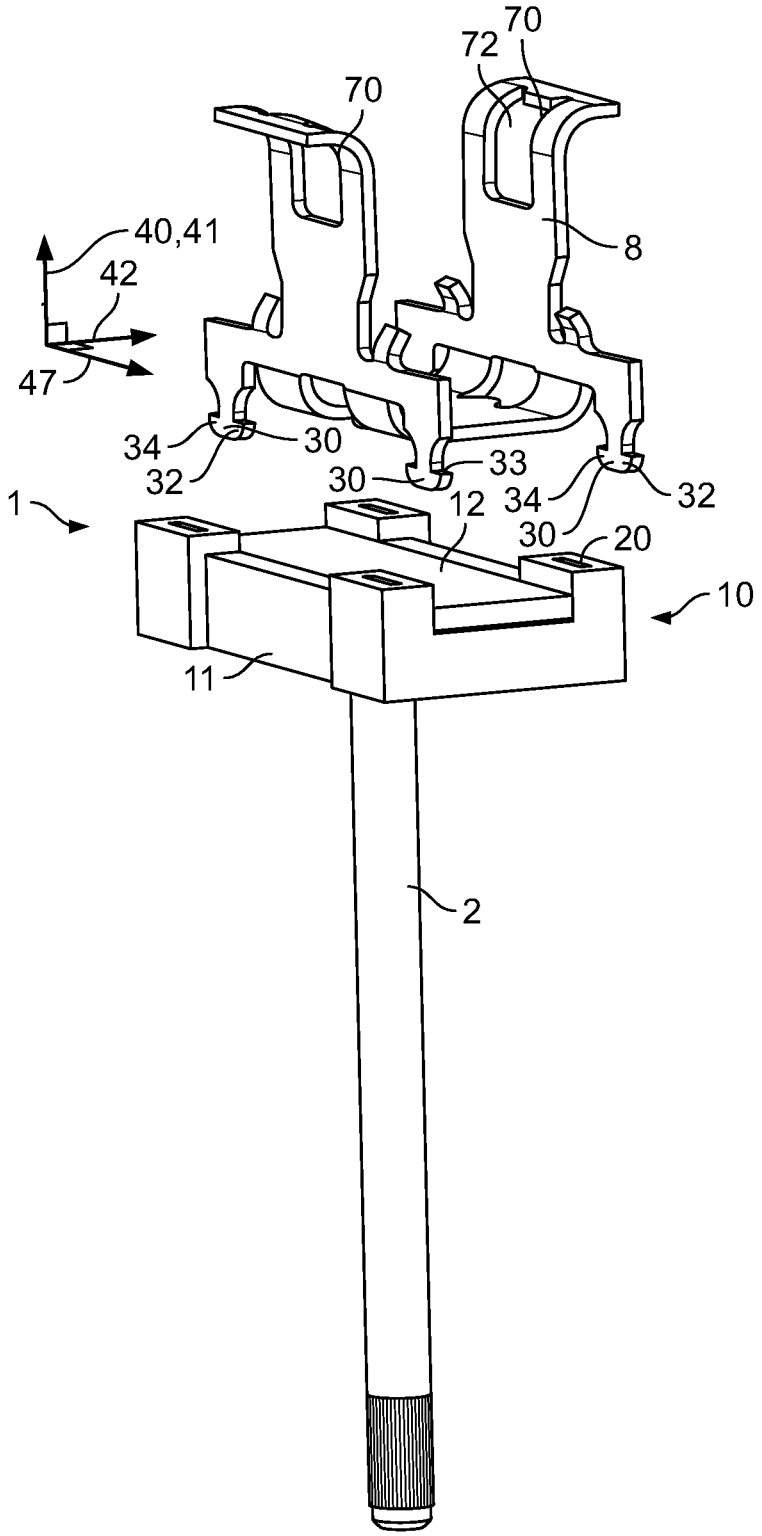
FIG. 3 is a perspective view of the component group of FIG. 1 with a switching bridge carrier prior to attachment of the switching bridge carrier.
Figure 4:
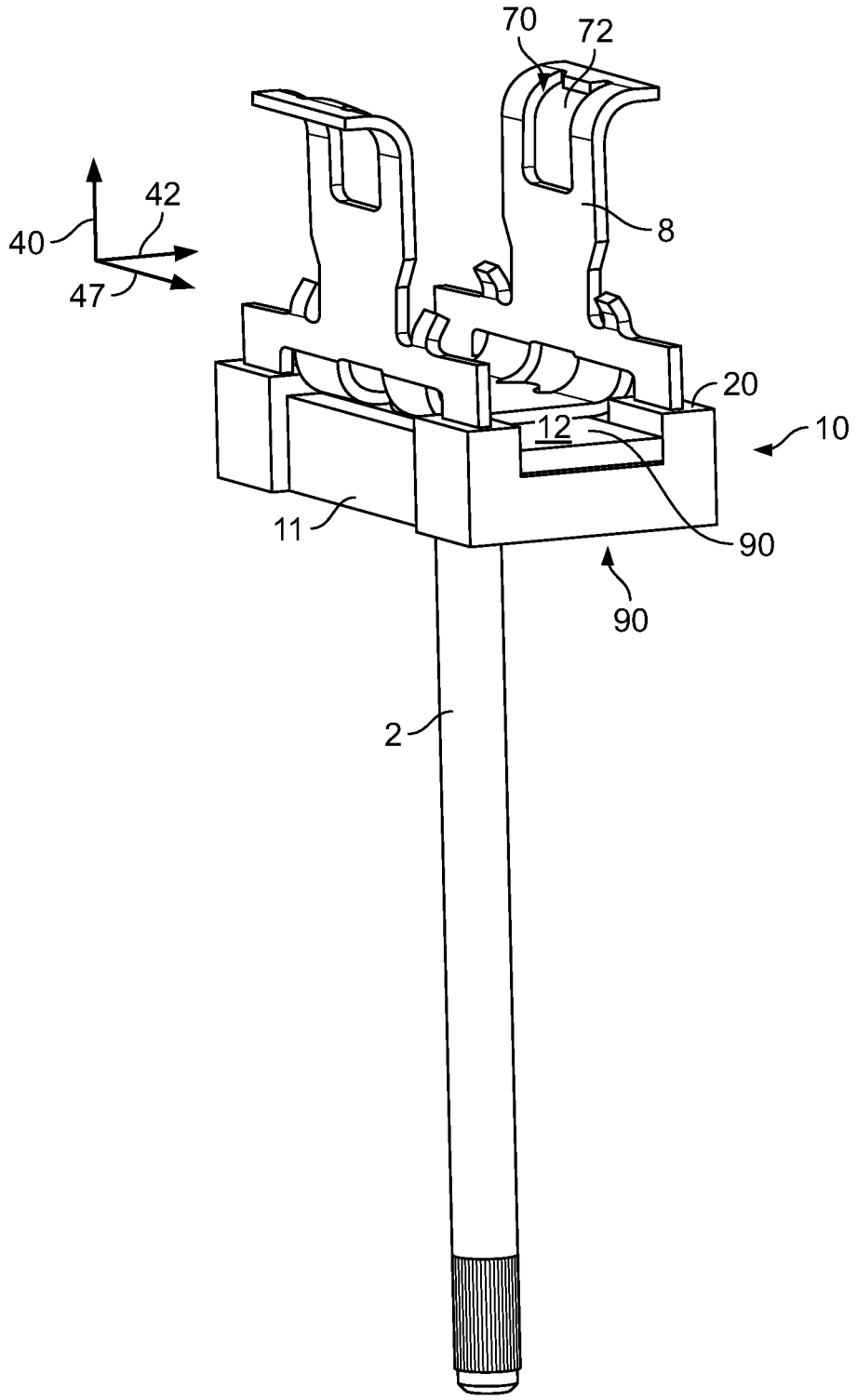
FIG. 4 is a perspective view of the component group of FIG. 1 with the switching bridge carrier attached.
Figure 5:
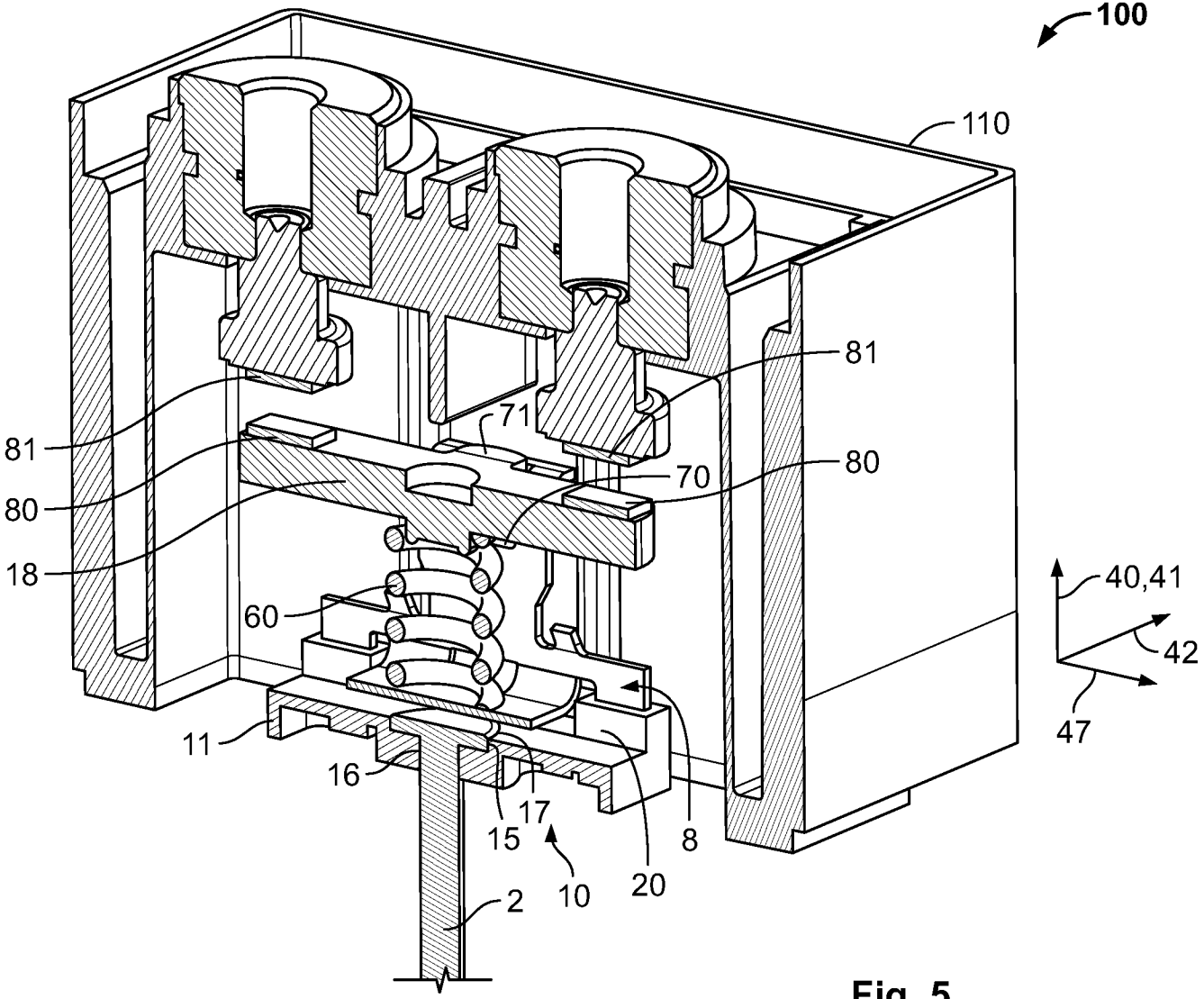
FIG. 5 is a sectional perspective view of a relay with the component group of FIG. 1.
Figure 6:
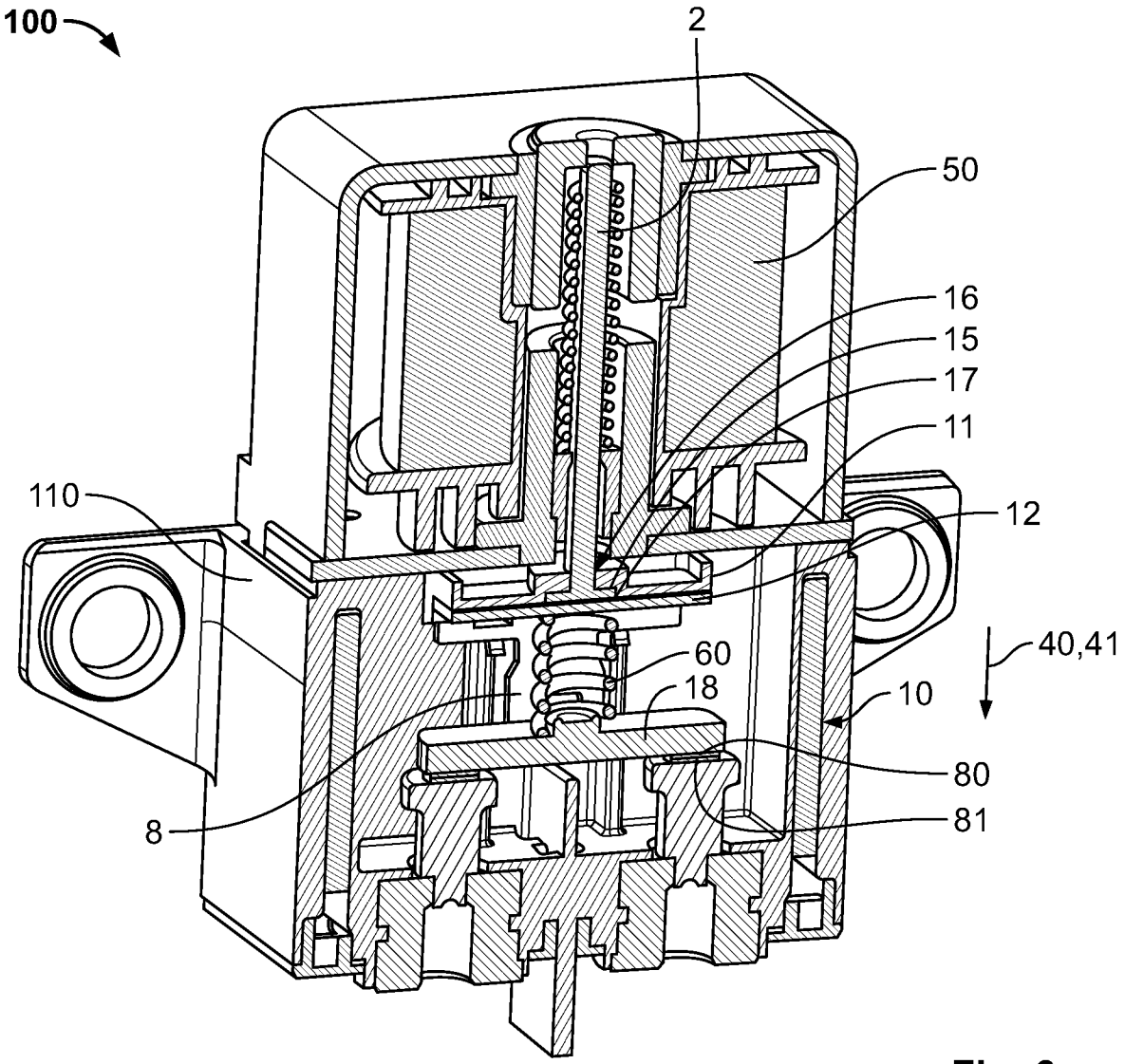
FIG. 6 is a sectional perspective view of the relay of FIG. 5 with an electromagnet.
Figure 7A:
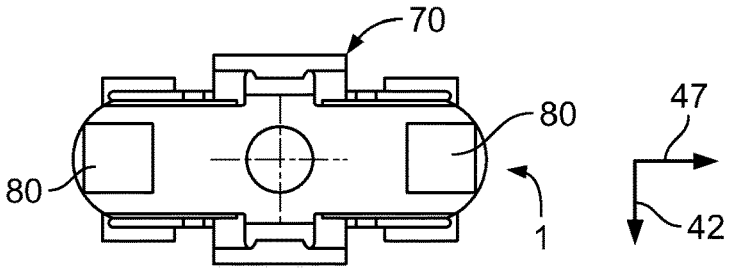
FIG. 7A is a top view of the component group of FIG. 4 with a switching bridge and a spring.
Figure 7B:
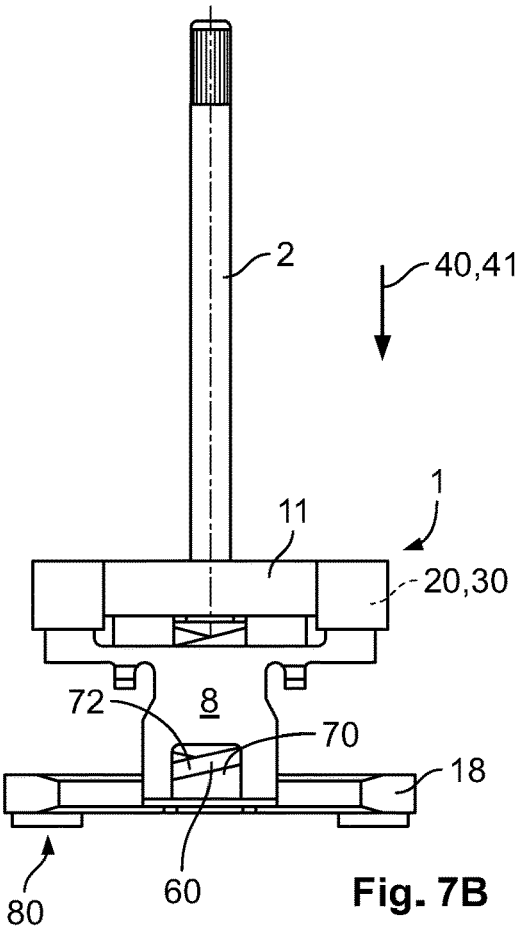
FIG. 7B is a side view of the component group of FIG. 7A.
Figure 7C:
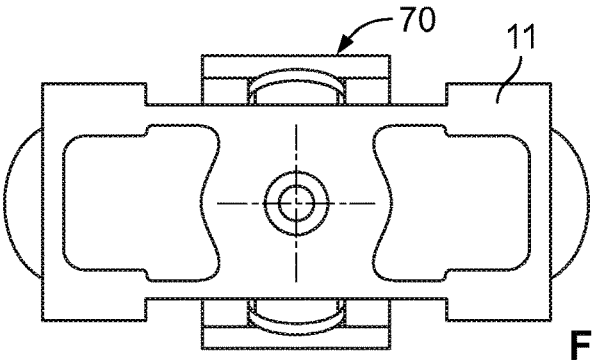
FIG. 7C is a bottom view of the component group of FIG. 7A.
Figure 7D:
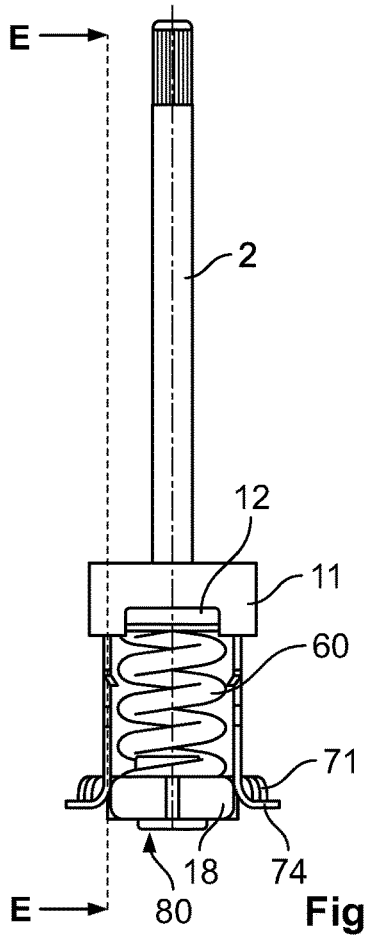
FIG. 7D is a side view of the component group of FIG. 7A.
Figure 7E:
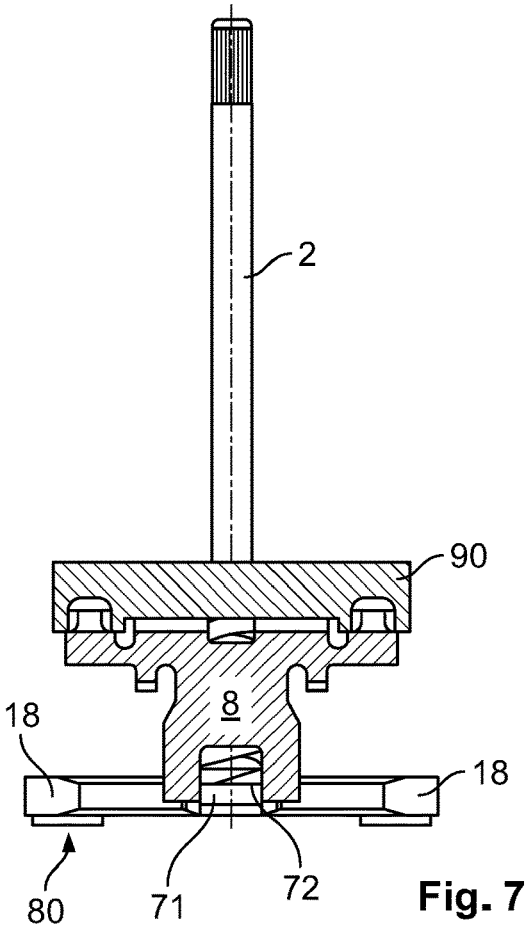
FIG. 7E is a sectional side view of the component group of 7A, taken along line E-E of FIG. 7D.

A component group 1 for a relay 100, according to an embodiment, is shown in FIGS. 1-7E. The relay 100, as shown in FIGS. 1, 5, and 6, comprises the component group 1, an armature 2, an electromagnet 50 of a control circuit operatively connected to the armature 2, a switching bridge 18 consisting of a conductive material and used to close and open a load circuit, a switching bridge carrier 8, and a spring 60 biasing the switching bridge 18.

The armature 2, as shown in FIG. 6, is operatively connected to the electromagnet 50 and is moved by the electromagnet 50 in a switching direction 40; a direction of movement 41 of the armature 2 results from different currents flowing through the electromagnet 50. The switching bridge 18 has a pair of contacts 80 which can come into contact with mating contacts 81.

The component group 1 electrically insulates the armature 2 from the switching bridge 18. As shown in FIGS. 5-7E, the component group 1 includes a separation component 10 electrically insulating and thus galvanically separating the armature 2 from the switching bridge 18 and a switching bridge carrier 8. The separation component 10 is formed an electrically insulating material. In an embodiment, the separation component 10 is formed of a plastic.

Figure 2:
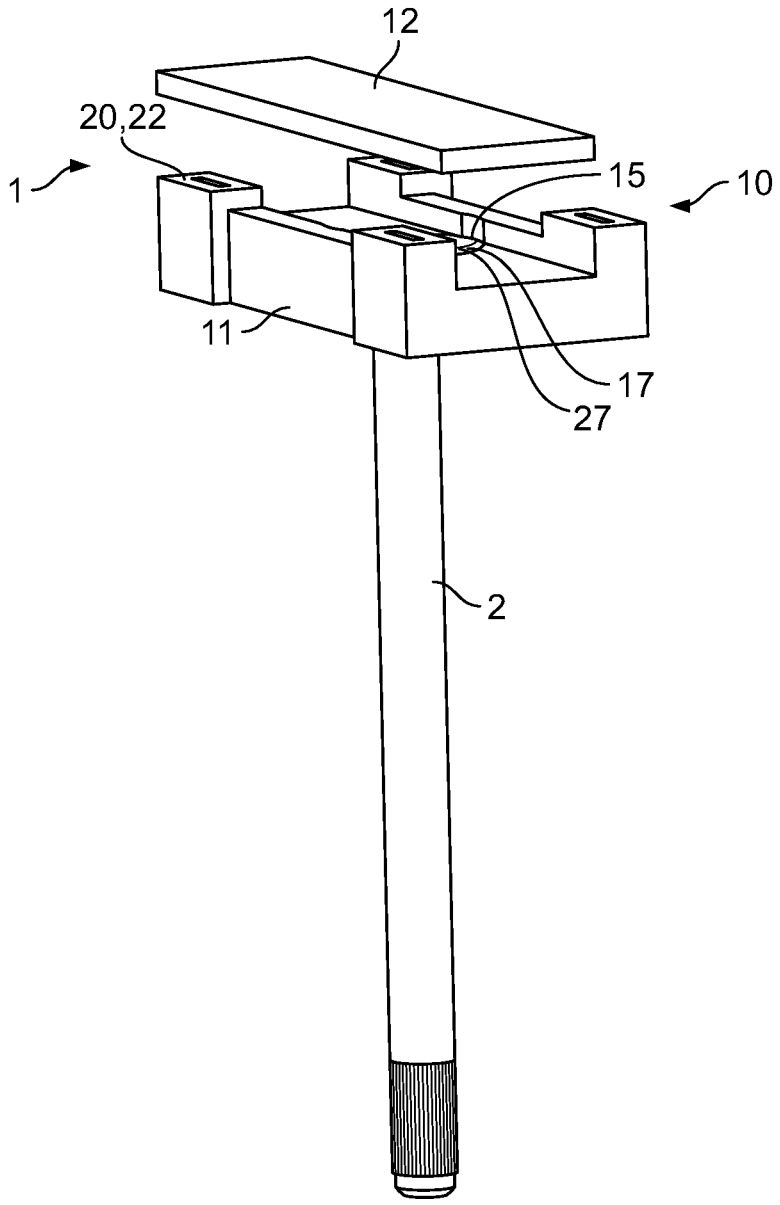
FIG. 2 is a perspective view of the component group of FIG. 1 with the armature inserted.

As shown in FIGS. 1, 2, and 5, the separation component 10 has a receiving section 11 with a receptacle 15 adapted to receive the armature 2. In the shown embodiment, the receptacle 15 is an aperture 16, into which the armature 2 can be inserted in a direction opposite the direction of movement 41. The aperture 16 has a recess 17 generating a form-fit with a head 27 of the armature 2 against the direction of movement 41.

After the armature 2 has been fully inserted, a cover 12 of the separation component 10 is moved over the head 27, as shown in FIGS. 2 and 3. In an embodiment, the component group 1 includes the armature 2. The cover 12 and receiving section 11 achieve an almost full insulation of the armature 2 in the region of the head 27. In the embodiment shown, the receiving section 11 and the cover 12 are two separate elements, so that these elements can have different materials and thus different properties. In other embodiments, the receiving section 11 and the cover 12 can be integrally formed in a single piece with one another. In another embodiment, the receiving section 11 and the cover 12 can be connected to each other by a film hinge, as a result of which the cover 12 on the receiving section 11 can be folded open in a simple manner. The aperture 16 and the cover 12 can be arranged behind one another in the switching direction 40, in order to enable a compact configuration in a lateral direction.

After the attachment of the cover 12, as shown in FIGS. 3 and 4, the switching bridge carrier 8 is brought into connection with the separation component 10, in particular with the receiving section 11. The receiving section 11 has receiving connection elements 20 and the switching bridge carrier 8 has carrier connection elements 30. In the embodiment shown in FIGS. 3 and 4, the connection elements 20, 30 are configured such that an ultrasonic welding process can connect them to one another. The carrier connection elements 30 are configured as press-in elements 32, and are pressed into the receiving connection elements 20, which are configured as press-in apertures 22. In order to obtain a retaining effect, the carrier connection elements 30 have undercuts 33 and thus form a mushroom structure 34. In an embodiment, the switching bridge carrier 8 is part of the component group 1. By initiating ultrasound vibrations in the switching bridge carrier 8, the carrier 8 and the separation component 10 can be joined with a small degree of force, with the press-in elements 32 being pre-pushed into the press-in apertures 22.

After the plugging-together has been carried out, one of the receiving connection elements 20 connected with one of the carrier connection elements 30 can be heated by ultrasound and their connection can be further secured as a result. In an embodiment, the connection elements 20, 30 have roughened surfaces or frictional elements which, during an ultrasonic welding process, generate friction and thus heat, which leads to welding.

The cover 12 is retained on the receiving section 11 by the switching bridge carrier 8, as shown in FIG. 4. In another embodiment, another type of connection can be present between the cover 12 and the receiving section 11; the cover 12 can be retained on the receiving section 11 in a form-fitting manner in or against the direction of movement 40. In an embodiment, a form-fit can be obtained via latching elements that can be deflected when the cover 12 is fastened to the rest of the separation component 10, and latch in and generate a form-fit only in a final state. In order to obtain a compact configuration in the direction of movement 40, the receiving section 11 and the cover 12 are each configured as flat bodies 90 extending transverse to the direction of movement 41, in a first transverse direction 42 and in a second transverse direction 47. The flat body 90 can extend substantially in two dimensions and, in a third dimension, can have an extent which is smaller than in the other dimensions by a specific factor, for example by a factor of 3.

The relay 100 with the separation component 10 is shown in an open state in FIG. 5 and in a closed state in FIG. 6. The cover 12 is omitted in FIG. 5 in order to show the recess 17 and the armature 2. The relay 100 comprises a housing 110 containing the components of the relay 100. The aperture 16 extends in a direction away from the switching bridge carrier 8. In another embodiment, the aperture 16 or receptacle 15 could be open towards the first transverse direction 42 or the second transverse direction 47, so that the armature 2 can be inserted laterally, i.e. transverse to the direction of movement 41. In such a lateral arrangement, the assembly can be simple because, in certain circumstances, it is possible to dispense with the cover 12 and nevertheless obtain a good insulation effect. For example, the creepage distance between the aperture 16 and other electrically conductive elements such as the switching bridge 18 can be sufficiently large to achieve an insulation effect. The spring 60 biases the switching bridge 18 in the direction of movement 41.

As shown in FIGS. 3-5 and 7A-7E, the switching bridge 18 has lateral protrusions 71 which cooperate with apertures 72 on the switching bridge carrier 8 and as a result form a guide 70. To limit the movement, there is a stop 74 on the switching bridge carrier 8 which cooperates with the lateral protrusions 71.

Figure 8A:
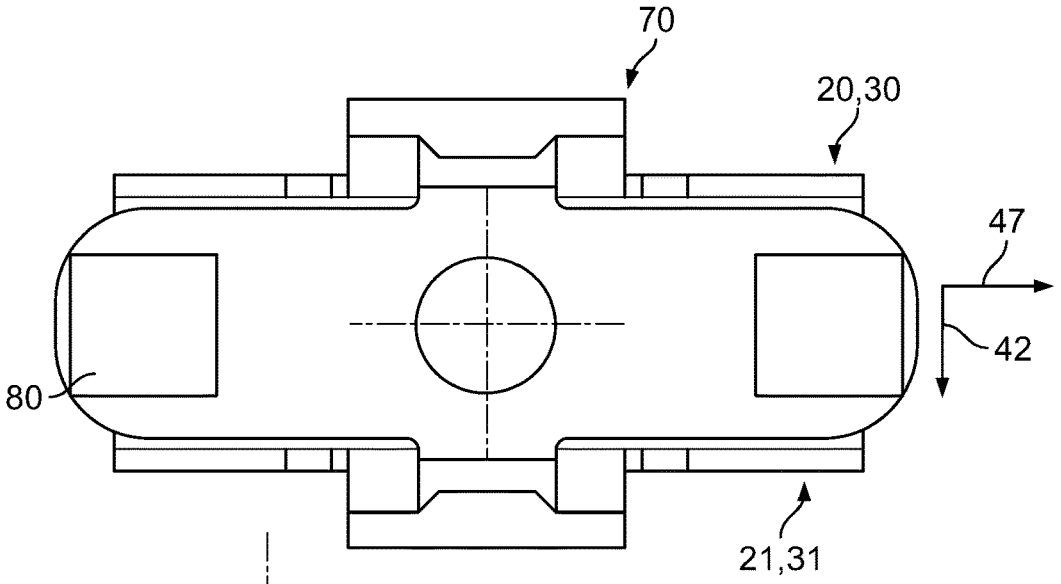
FIG. 8A is a top view of a component group according to another embodiment.
Figure 8B:
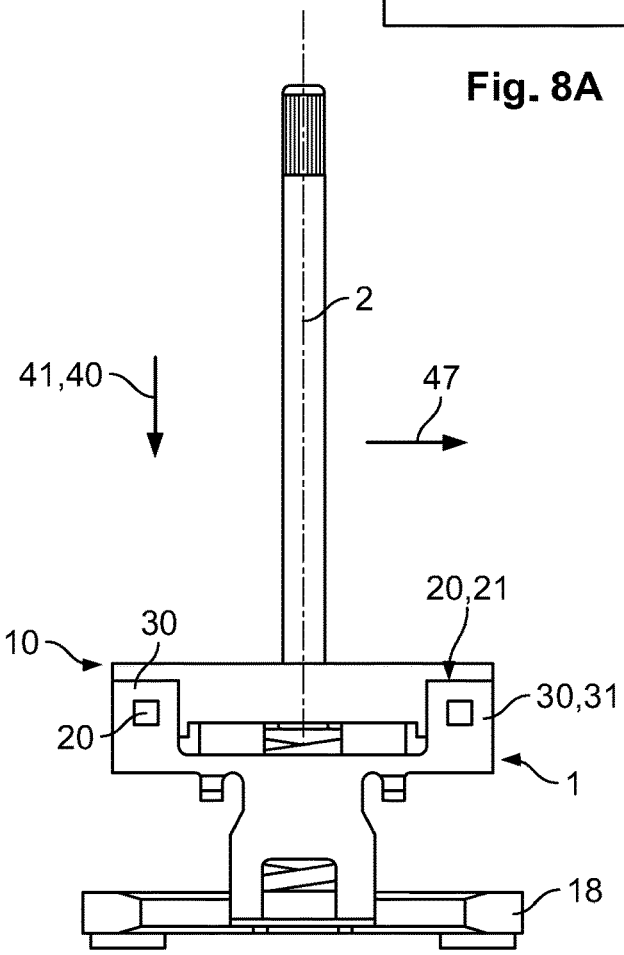
FIG. 8B is a side view of the component group of FIG. 8A.
Figure 8C:
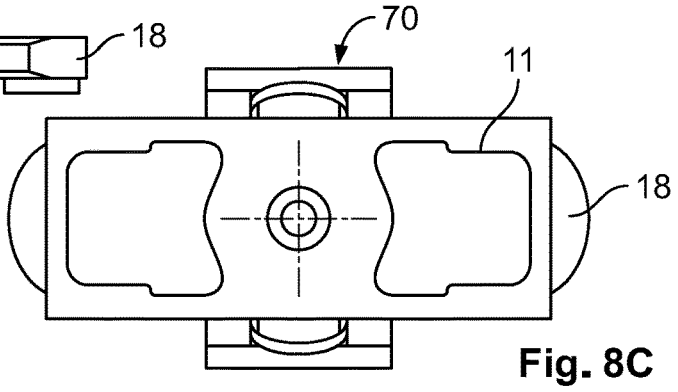
FIG. 8C is a bottom view of the component group of FIG. 8A.
Figure 8D:
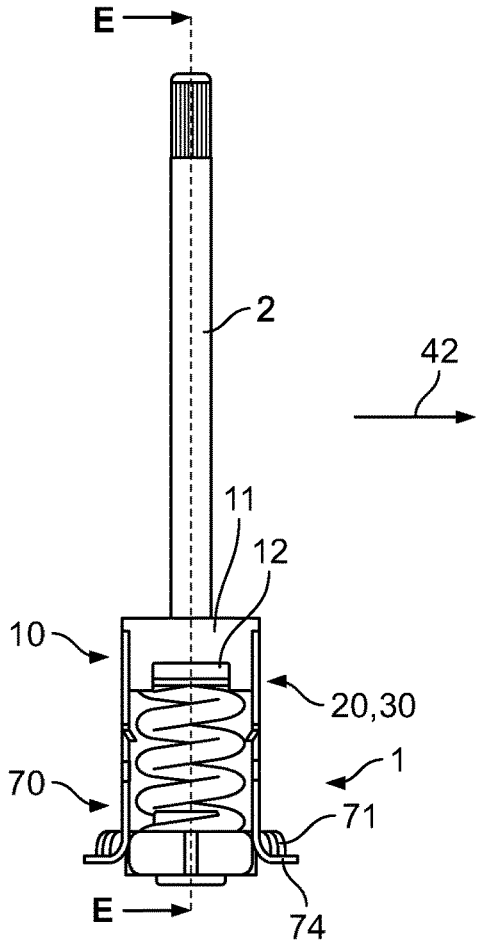
FIG. 8D is a side view of the component group of FIG. 8A.
Figure 8E:
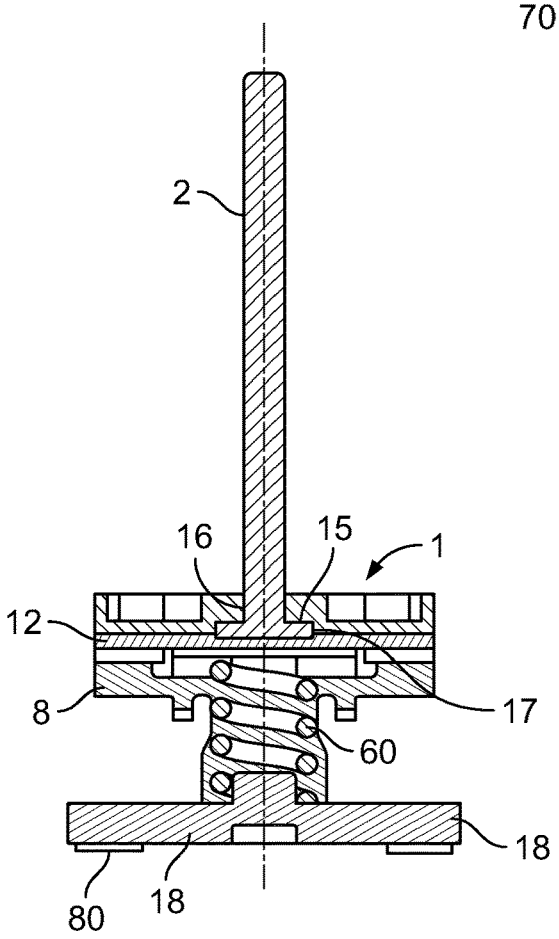
FIG. 8E is a sectional side view of the component group of FIG. 8A.
Figure 9:
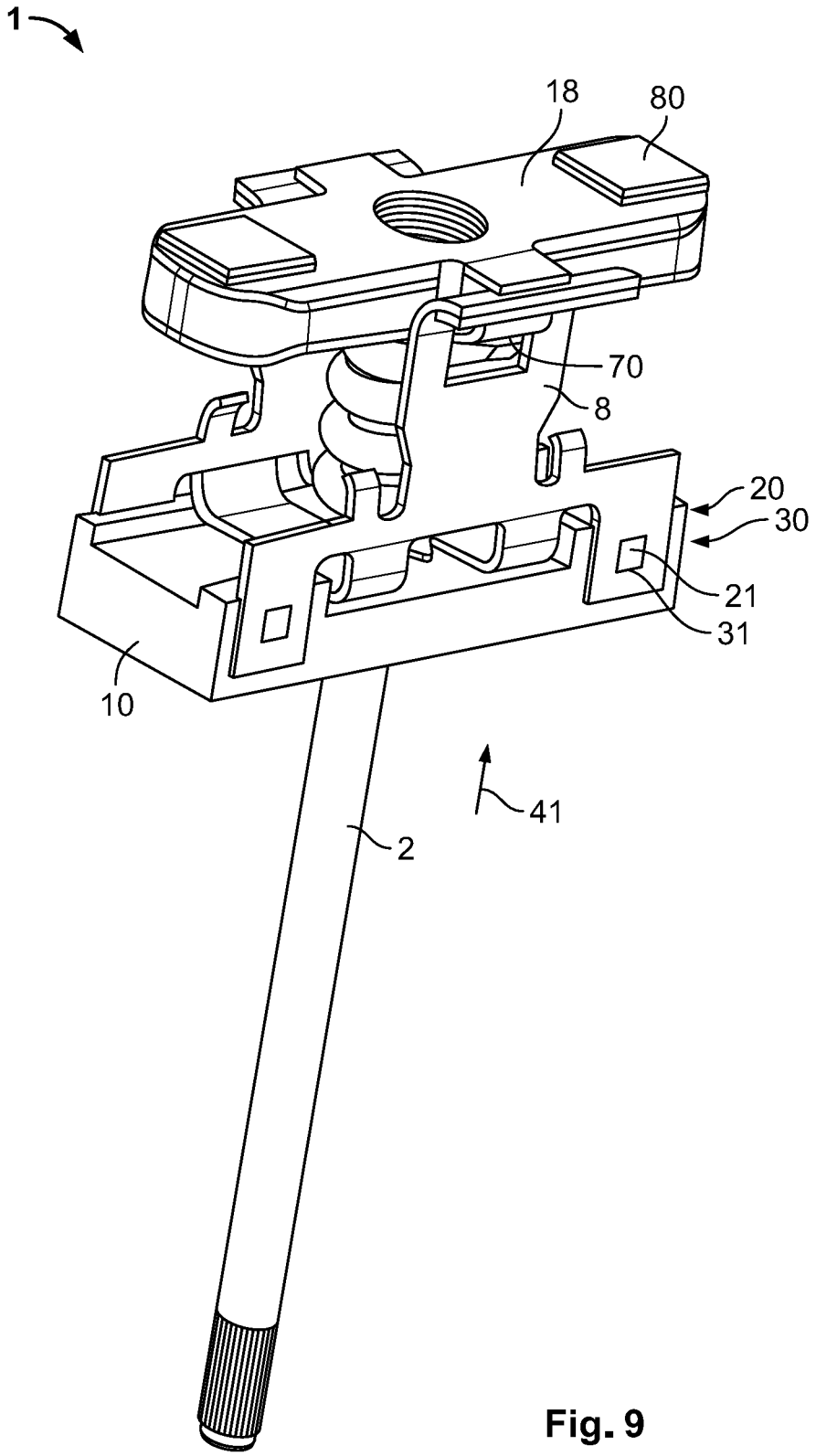
FIG. 9 is a perspective view of the component group of FIG. 8A.

Another embodiment of a component group 10 is shown in FIGS. 8A-9. In contrast to the embodiment shown in FIGS. 1-7E, the switching bridge carrier 8 is attached via connection elements 20, 30 in the form of form-fit elements 21, 31. The connection elements 20, 30 are each arranged on an exterior side in order to be able to be easily reached. The form-fit elements 21, 31 comprise protrusions and apertures for the protrusions and ensure a form-fit along the direction of movement 41.

What is claimed is:

1. A component group of a relay, comprising:

a separation component formed from an electrically insulating material and having a receptacle receiving an armature of the relay and a plurality of receiving connection elements adapted to plugged together with a switching bridge carrier of the relay, a switching bridge of the relay is arranged on the switching bridge carrier and the separation component galvanically separates the armature and the switching bridge, the separation component has an aperture receiving the armature and a cover adapted to cover the aperture.

2. The component group of claim 1, wherein the cover is retained in a form-fitting manner in at least one spatial direction on a receiving section of the separation component, the receptacle is arranged on the receiving section.

3. The component group of claim 2, wherein the cover and the receiving section are integrally formed in a single piece with one another.

4. The component group of claim 1, wherein the cover is adapted to be folded over the receptacle.

5. The component group of claim 2, wherein the cover is attached to the receiving section by a film hinge.

6. The component group of claim 1, wherein the receiving connection elements are a plurality of form-fit elements.

7. The component group of claim 1, wherein the receiving connection elements are configured for connection by ultrasonic welding.

8. The component group of claim 1, wherein the receiving connection elements are a plurality of press-in apertures.

9. The component group of claim 2, wherein the receiving section and/or the cover is configured as a flat body.

10. A component group of a relay, comprising:

an armature;

a switching bridge carrier, a switching bridge of the relay is arranged on the switching bridge carrier; and a separation component formed from an electrically insulating material and having a receptacle receiving the armature and a plurality of receiving connection elements adapted to plugged together with the switching bridge carrier, the separation component galvanically separates the armature and the switching bridge, the separation component has an aperture receiving the armature and a cover adapted to cover the aperture.

11. The component group of claim 10, wherein the cover is retained by the switching bridge carrier.

12. The component group of claim 11, wherein the switching bridge carrier has a plurality of carrier connection elements engaging the receiving connection elements.

13. A relay, comprising:

an armature;

a switching bridge carrier;

a switching bridge arranged on the switching bridge carrier; and a component group including a separation component formed from an electrically insulating material and having a receptacle receiving the armature and a plurality of receiving connection elements adapted to plugged together with the switching bridge carrier, the separation component galvanically separates the armature and the switching bridge, the separation component has an aperture receiving the armature and a cover adapted to cover the aperture.

* * * * *